US008448796B2

(12) United States Patent
Silver

(10) Patent No.: US 8,448,796 B2
(45) Date of Patent: May 28, 2013

(54) ARTIFICIAL NIPPLE WITH REINFORCEMENT

(75) Inventor: Brian H Silver, Cary, IL (US)

(73) Assignee: Medela Holding AG, Baar (CH)

( * ) Notice: Subject to any disclaimer, the term of this patent is extended or adjusted under 35 U.S.C. 154(b) by 150 days.

(21) Appl. No.: 12/972,721

(22) Filed: Dec. 20, 2010

(65) Prior Publication Data

US 2011/0240586 A1 Oct. 6, 2011

Related U.S. Application Data

(63) Continuation of application No. 11/173,860, filed on Jun. 30, 2005, which is a continuation-in-part of application No. 10/696,910, filed on Oct. 29, 2003, now Pat. No. 7,712,617.

(60) Provisional application No. 60/424,954, filed on Nov. 8, 2002.

(51) Int. Cl.
*A61J 11/00* (2006.01)

(52) U.S. Cl.
USPC ..... 215/11.1

(58) Field of Classification Search
USPC ..... 215/11.1; 606/234, 236
See application file for complete search history.

(56) References Cited

U.S. PATENT DOCUMENTS

| | | | | | |
|---|---|---|---|---|---|
| 589,212 | A | | 8/1897 | Michael | |
| 605,161 | A | | 6/1898 | Wilkinson et al. | |
| 633,343 | A | | 9/1899 | Heany | |
| 686,109 | A | * | 11/1901 | Mulhens | 215/11.1 |
| 1,146,639 | A | | 7/1915 | Miller | |
| 1,280,942 | A | | 10/1918 | Apple | |
| 1,632,854 | A | | 3/1923 | Rogers | |
| 1,545,436 | A | | 7/1925 | McGeary | |
| 1,569,693 | A | * | 1/1926 | Young | 215/11.4 |
| 1,656,157 | A | | 3/1926 | Correnti | |
| 1,672,734 | A | | 3/1926 | Reilly | |
| 1,588,846 | A | | 6/1926 | McGeary | |
| 1,590,152 | A | * | 6/1926 | Dreyfus | 215/11.1 |
| 1,672,466 | A | | 6/1928 | Oshman et al. | |
| 1,859,733 | A | | 4/1930 | Fort | |
| 1,913,627 | A | | 11/1931 | Epstein | |
| 1,848,533 | A | * | 3/1932 | Lasky | 215/11.1 |
| 2,005,437 | A | | 12/1932 | Naum | |
| 1,989,060 | A | | 3/1933 | Liddick | |

(Continued)

FOREIGN PATENT DOCUMENTS

| | | |
|---|---|---|
| DE | 113496 | 9/1900 |
| EP | 0300786 | 1/1989 |

(Continued)

OTHER PUBLICATIONS

European Search Report, PCT/US2006025010, mailed Oct. 16, 2012.

(Continued)

*Primary Examiner* — Sue A Weaver
(74) *Attorney, Agent, or Firm* — McDonnell Boehnen Hulbert & Berghoff LLP

(57) ABSTRACT

The invention is directed to an improved feeding nipple, including a substantially solid nipple portion. The nipple includes one or more ducts formed therethrough for conveying fluids through the nipple. The nipple is radially compressible and a reinforcing member is disposed in the nipple adjacent the one or more ducts.

11 Claims, 9 Drawing Sheets

U.S. PATENT DOCUMENTS 2,001,842 A * 5/1935 Heise et al. ..... 215/11.1
2,060,212 A 6/1935 Herstein
2,366,214 A 6/1940 Ramaker
2,321,236 A 11/1940 Parkin
2,638,094 A 1/1947 Kronish
2,655,920 A 12/1948 Cronin
2,736,446 A 9/1952 Raiche
2,825,479 A 6/1954 Litzie
3,139,064 A 8/1957 Harle
2,889,829 A 6/1959 Tannenbaum et al.
3,022,915 A 8/1959 Mullin
3,070,249 A 11/1960 Sehrwald
3,126,116 A 10/1961 Clinehens
3,082,770 A 12/1961 Straub
3,190,288 A 7/1962 Butler et al.
3,193,125 A 12/1963 Fischer
3,424,157 A 1/1969 Di Paolo
3,530,979 A 9/1970 Merrill, Jr. et al.
3,593,870 A 7/1971 Anderson
3,645,413 A 2/1972 Mitchell
3,650,270 A 3/1972 Frazier
3,661,288 A 5/1972 Noll
3,777,753 A 12/1973 Kesselring et al.
3,779,413 A 12/1973 Pickerell et al.
3,787,993 A 1/1974 Lyon
3,790,016 A 2/1974 Kron
3,790,017 A 2/1974 Fitzpatrick et al.
3,858,741 A 1/1975 Smith, Sr.
3,946,888 A 3/1976 Tonkin
4,006,836 A 2/1977 Micallef
4,195,638 A 4/1980 Duckstein
4,238,040 A 12/1980 Fitzpatrick
4,311,245 A 1/1982 Maffei
D273,515 S 4/1984 Fabjancic
4,505,398 A 3/1985 Kesselring
4,586,621 A 5/1986 Dahan
4,619,271 A 10/1986 Burger et al.
4,623,069 A * 11/1986 White ..... 215/11.1
4,676,386 A 6/1987 Phlaphongphanich
4,688,571 A 8/1987 Tesler
4,700,856 A 10/1987 Campbell et al.
4,759,139 A 7/1988 Ricks
4,815,615 A 3/1989 Phlaphongphanich
4,832,214 A 5/1989 Schrader et al.
4,834,099 A 5/1989 Schrooten
4,941,573 A 7/1990 Fuerstman
4,993,568 A 2/1991 Morifuji et al.
5,004,473 A 4/1991 Kalantar
5,013,321 A 5/1991 MacVane
5,035,340 A 7/1991 Timmons
5,069,351 A 12/1991 Gunderson et al.
5,072,842 A 12/1991 White
5,101,991 A 4/1992 Morifuji et al.
5,114,374 A 5/1992 Estiva
5,117,994 A 6/1992 Leblanc et al.
D330,938 S 11/1992 Sakashita
5,207,338 A 5/1993 Sandhu
5,322,031 A 6/1994 Lerner et al.
5,474,028 A 12/1995 Larson et al.
5,499,729 A 3/1996 Greenwood et al.
D371,848 S 7/1996 Searles
5,535,899 A * 7/1996 Carlson ..... 215/11.1
5,542,922 A 8/1996 Petterson et al.
5,544,766 A 8/1996 Dunn et al.
5,553,726 A 9/1996 Park
5,598,809 A 2/1997 McInnes
5,673,806 A * 10/1997 Busnel ..... 215/11.1
5,688,328 A 11/1997 Tong et al.
5,690,679 A 11/1997 Prentiss
D417,735 S 12/1999 Ford
6,003,698 A 12/1999 Morano
6,032,810 A 3/2000 Meyers et al.
6,161,710 A 12/2000 Dieringer et al.
6,241,110 B1 6/2001 Hakim
6,253,935 B1 7/2001 Fletcher
6,270,519 B1 8/2001 Botts
6,343,704 B1 2/2002 Prentiss
6,588,613 B1 7/2003 Pechenik et al.
6,675,981 B1 1/2004 Lesko
6,736,830 B2 5/2004 Roust
6,745,912 B2 6/2004 Uchara et al.
6,818,162 B1 11/2004 Hoffman et al.
6,871,751 B2 3/2005 Kerns et al.
6,968,964 B2 11/2005 Gilmore
7,287,657 B1 * 10/2007 Rodriguez ..... 215/11.1
2003/0032984 A1 2/2003 Hakim
2003/0089676 A1 * 5/2003 Uehara et al. ..... 215/11.1
2003/0093120 A1 5/2003 Renz
2003/0093121 A1 5/2003 Randolph
2004/0026351 A1 2/2004 Dunn et al.
2004/0045922 A1 3/2004 Holley
2004/0124168 A1 7/2004 Silver
2004/0182813 A1 9/2004 Gilmore
2004/0245203 A1 12/2004 Goldman et al.
2005/0258123 A1 11/2005 Silver
2006/0011571 A1 1/2006 Silver

FOREIGN PATENT DOCUMENTS

FR 434459 2/1912
FR 27006890 7/1994
GB 347368 4/1931
GB 2208291 1/1989
JP 61-244360 10/1986
JP 2-264660 10/1990
JP 02264660 A * 10/1990
JP 4-41864 10/1992
JP 5-37313 1/1995
JP 7-1939 1/1995
JP 2000313498 11/2000
JP 2002011076 1/2002
JP 2002011076 A * 1/2002
WO 86/06273 11/1986
WO 00/48491 8/2000
WO 2004/010921 2/2004
WO WO 2004/010921 A1 * 2/2004
WO 2004/043325 5/2004

OTHER PUBLICATIONS

ESRIDS1, PCT/US03/35379.
ESRIDS2, PCTIUS06/25010.

* cited by examiner

FIG. 20
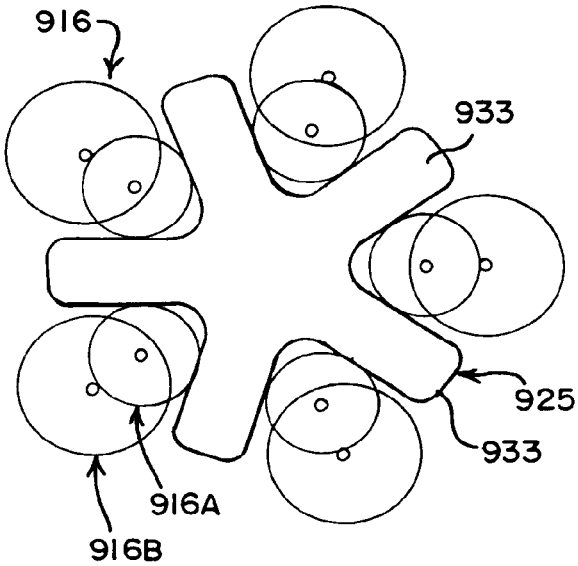
FIG. 21
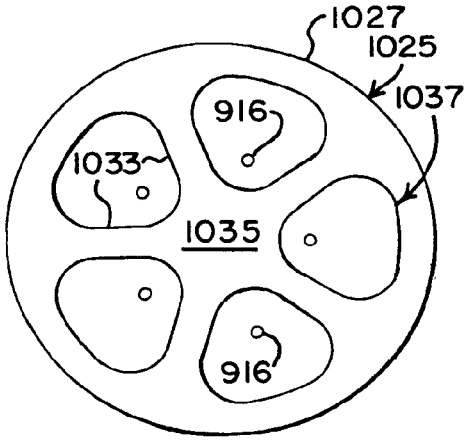
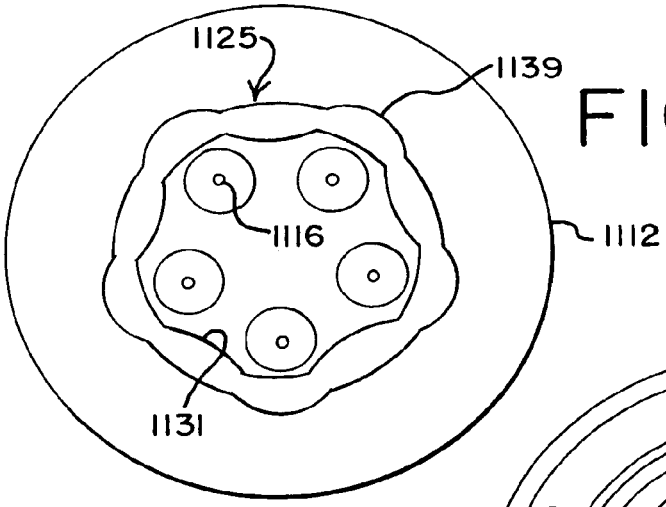
FIG. 22
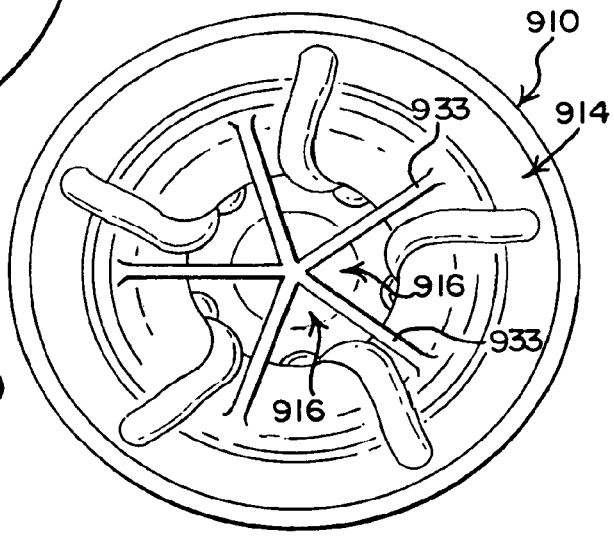
FIG. 23

ARTIFICIAL NIPPLE WITH REINFORCEMENT

This application is a continuation of U.S. Ser. No. 11/173,860, filed Jun. 30, 2005, which is a continuation in part of U.S. Ser. No. 10/696,910 for Artificial Nipple, filed Oct. 29, 2003, now U.S. Pat. No. 7,712,617 claiming priority to provisional application U.S. Ser. No. 60/424,954, filed Nov. 8, 2002. The entirety of the disclosure of the foregoing U.S. Ser. Nos. 11/173,860 and 10/696,910 are hereby incorporated by reference, as if fully set forth herein.

FIELD OF THE PRESENT INVENTION

The present invention generally relates to an artificial nipple for use with a bottle for the purpose of feeding, such as an infant.

BACKGROUND OF THE INVENTION

The merits of breast-feeding are well documented in the scientific literature. A number of advantages have been noted which include nutritional, immunological, psychological and other general health advantages. A list of the merits of human breast milk as compared to artificial feed or formula would include ideal nutritional content, better absorption, fewer food related allergies, more favorable psychological development, better immunological defenses, and a substantial economic advantage. Another benefit to exclusive breast-feeding includes positive effects on development of an infant's oral cavity resulting in proper alignment of teeth and other related benefits.

For various reasons, however, exclusive breast-feeding is not always possible. An example of this would be where a nursing mother cannot produce enough breast milk to feed her infant. In such cases, an artificial feed may be used to supplement breast-feeding. A nursing mother returning to work may employ a breast pump to express milk to be given to her infant at a later time. In the event that an infant is fed with an artificial formula or previously expressed breast milk, it is conventional that a bottle provided with an artificial nipple is used to feed the infant.

The mechanical aspects of breast-feeding are significantly different compared to that of bottle-feeding. In breast-fed babies, the tongue action appears to be of rolling or peristaltic motion. However, the tongue action for bottle-fed babies is often considered to be more piston-like or a squeezing motion. In order to stop the abundant flow of milk from a bottle with an artificial nipple having a large hole in the end, infants might be forced to hold the tongue up against the hole of the nipple to prevent the formula from gushing forth. This abnormal activity of the tongue is referred to as tongue thrust or deviate swallow. When breast-fed babies are not sucking or swallowing, they may rest with the nipple moderately indented by the tongue, while bottle-fed babies rest with the teat expanded, i.e., indenting the tongue. The differences between the tongue movements and rest position of the tongue and breast-fed and bottle-fed babies are probably due to the properties of the artificial nipple.

The undesirable effects of existing artificial nipples are often permanent and correction later in life is difficult due at least in part to effected muscle development. The shape of a breast nipple is dictated by the internal geometry of the infant's mouth during breast-feeding. However, an artificial teat is already formed with a specific shape and is made from a material stiffer than breast tissue.

Recent research suggests that in the early stages of oral cavity development, the palette is almost as malleable as softened wax. As a result, children who are bottle-fed are nearly twice as likely to have malocclusions as children who are breast-fed. In the same way that finger sucking and use of a pacifier-like object has been found to increase the prevalence of malocclusions it is now believed that use of a conventional artificial nipple also impacts negatively upon formation of the oral cavity.

A demand therefore exists for an artificial nipple that more closely mimics that of a natural breast and reduces or eliminates the impact of bottle-feeding with respect to oral development. The present invention is believed to satisfy this demand.

SUMMARY OF THE INVENTION

An object of the invention is to provide an artificial nipple that is made of a material that minimally impacts infant oral development. Another object of the invention is to provide an artificial nipple that permits milk to flow therefrom at typical breast-feeding suction levels. Yet another object of the invention is to provide an artificial nipple that does not permit milk to flow through or substantially stops that flow when compressed, or constricted radially through elongation. Still yet another object of the invention is to provide an artificial nipple that is positioned in the oral cavity in a similar fashion as that of a mother's to nipple. Another object of the invention is to provide an artificial nipple that permits milk or other fluids to flow therefrom in a manner and rate similar to that of a mother's nipple.

Overall, the nipple of the present invention is designed in one broad sense to encourage a suck/swallow/breathe pattern similar to that of natural is breastfeeding. This reduces or eliminates the undesired forcing of breast milk to a feeding infant.

In one aspect of the present invention, a baby feeding apparatus includes a substantially solid nipple with one or more ducts formed therethrough for conveying fluids through the nipple. The nipple is radially compressible so as to prevent passage of fluids through the one or more ducts when so compressed. Similarly, the nipple constricts radially so as to prevent passage of fluids when elongated (stretched).

In a particular aspect of the foregoing invention, the nipple may be a Shore A hardness of less than about 10, and even below 1. More particularly, on the Shore 00 scale, a range of about 20 to about 45 is presently considered most desirable. The nipple may include three or more elongated ducts. The fluid ducts may further be offset radially with respect to a central axis of the nipple in another variation. Further still, the end openings of the ducts can be radially offset relative to the central axis of the ducts themselves.

In one embodiment, the nipple may include a unitary nipple portion and mounting portion. The mounting portion may be formed of a material having the same Shore A hardness as that of the nipple portion, but in this embodiment, the mounting portion may be formed of a material having a relatively higher Shore A hardness to that of the nipple portion. This provides a more rigid structure for attachment to a container, for instance.

In another form, the nipple may include a nipple end and a body portion. The body portion may include a vent formed therethrough, or multiple vents. The vent may include a horizontal passageway in communication with atmosphere, and a vertical passageway in communication at a first end to the horizontal passageway and at a second end to an inner chamber of the nipple.

Another aspect of the invention provides a baby feeding apparatus including a substantially solid nipple being formed of a material having a Shore A hardness of less than about 10, and one or more ducts at or near the nipple tip for conveying fluids through the nipple, and most preferably extending through the generally solid nipple portion.

Yet another aspect of the invention provides a baby feeding apparatus including a substantially solid nipple having one or more ducts formed therethrough for conveying fluids through the nipple, and a flow restrictive feature. One flow restrictive feature prevents passage of fluids through the one or more ducts when the nipple is one or both of radially compressed and axially extended. Another is just the small size of the terminal hole at the end of a duct as disclosed herein, which is sufficient alone to restrict fluid flow, as well as the use of a valve or valve-like end feature. It has been observed that these flow restrictive features reduce the amount of air that could otherwise return to the fluid container. With the vented structure disclosed herein, this serves to prevent the infant (user) from taking in unwanted air with feeding. The ducts may be round in cross-section. In another embodiment, the ducts may terminate in longitudinal slits. In yet another embodiment, the ducts may terminate in "S"-shaped slits or "Y"-shaped slits.

Yet another aspect of the invention provides an integral (one-piece) nursing nipple including a substantially solid nipple formed of a material having a Shore A hardness of less than about 10, and a container attachment portion formed to be unitary with the nipple portion.

Yet another aspect of the invention provides an integral nursing nipple including a substantially solid nipple portion formed of a material having a Shore A hardness of less than about 10, and an extending elongated portion sized and shaped to be insertable into the mouth of a nursing infant. The extending portion includes a proximal portion and a base portion and one or more ducts through the solid nipple portion from the proximal portion to the base portion. The base portion has a radial flange extending outwardly therefrom, and a container attachment portion formed to be unitary with the nipple portion. The container attachment portion is generally cylindrical, and has a first end connected to the radial flange and a second end. The second end includes an internal groove formed about an internal periphery thereof. The internal groove is sized and shaped so as to be removably attachable to a container having a matching thread (although this mating thread and groove arrangement could be reversed).

Yet another aspect of the present invention provides an integral nursing nipple including a substantially solid nipple formed of a material having a Shore A hardness of less than about 10, and an extending portion sized and shaped to be insertable into the mouth of a nursing infant. The extending portion includes one or more ducts extending therethrough for conveying fluids, and a base portion. A container attachment portion is attached to the base portion. The container attachment portion is generally cylindrical and has a first end with a flange. The flange extends inwardly from the first end and includes a plurality of openings formed therethrough. In manufacture the soft base portion enmeshes with the flange through the openings. The container attachment portion includes means for attachment to a container, such as screw threads, a snap-fit, etc.

Another aspect of one embodiment of the invention is to provide as low a Durometer material for the nipple portion of the artificial nipple as possible. Preferably, a relatively higher durometer material is provided for the collar portion. The nipple portion may be molded or connected directly to the collar or mounting portion or may be a more conventional nipple/collar configuration.

Still another aspect of an embodiment of the invention is the positioning of a valve at the distal end of each duct to regulate the flow of fluids through each duct. The valve is designed to open and close depending on the suckling action.

One of the most significant attributes of the present invention is nonetheless considered to be the very low Durometer material of the nipple extending portion, and how that material behaves under manipulation by the infant in suckling, both in extension and also in compression. The elongated duct(s) in the preferred substantially solid embodiment appear to react much more like a mother's nipple than any prior art artificial nipple with this very low Durometer material. The infant also is believed to engage the soft area surrounding and extending outwardly from the distal end of the extending portion in a manner much more reminiscent of feeding at the breast. Furthermore, and unlike many prior art artificial nipples, the present invention permits the fluid flow characteristics of the nipple to respond to changes in vacuum. It is believed that the low Durometer material of the nipple, possibly in combination with other features of the present invention, can be tailored to allow a higher fluid flow rate at a relatively increased vacuum (by the infant).

As will be evident herein, the most preferred durometers are considered to be in the range at or below about Shore A 5, which would be most preferably around Shore 00 20 to 45. Even below the latter range may be useful.

Another way to look at the desired result in this nipple insofar as extension and compression under suckling, is through the elongation of the nipple material. Materials that have appeared very useful for the elongated portion of the nipple have shown a stress of approximately 40 psi or less at 300% elongation in a most preferred embodiment.

The present invention represents an improvement in the artificial nipple previously disclosed in the foregoing application, through the use of various means to reinforce the elongated part of the nipple that extends into the user's mouth.

These, together with other objects and advantages will be further understood in the details of the construction and operation of the invention as more fully hereinafter described, reference being had to the accompanying drawings, forming a part hereof, wherein like numerals refer to like part throughout.

BRIEF DESCRIPTION OF DRAWINGS

FIG. 20 is a cross-sectional view looking along the long axis of another embodiment of a reinforcing element to be embedded in the nipple;

FIG. 21 is a cross-sectional view looking along the long axis of another embodiment of a reinforcing element to be embedded in the nipple;

FIG. 22 is a cross-sectional view looking along the long axis of another embodiment of a reinforcing element to be embedded in the nipple, where both the interior and exterior of the element have been modified from a smooth circle; and FIG. 23 is a view looking from the bottom up toward the top (proximal end) of another embodiment of a nipple having an internal web-type reinforcement member similar to that of FIG. 20.

DESCRIPTION OF PREFERRED EMBODIMENTS

Figure 1:
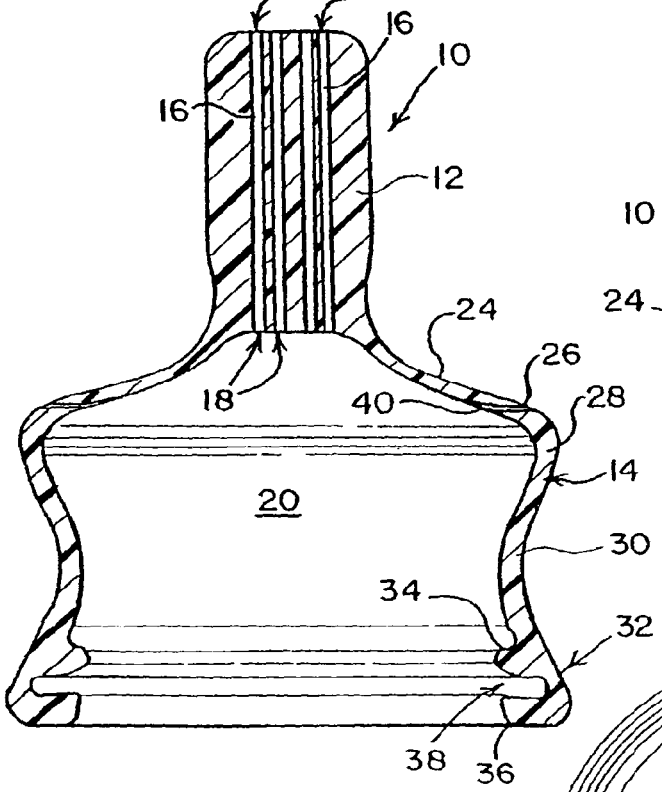
FIG. 1 is a sectional view of one embodiment of a nipple according to the present invention.

FIG. 1 shows an embodiment of a nipple, illustrated generally at 10, for use with a container, such as a bottle or bag. The nipple 10 may be made of any suitable material, but in a preferred form is made of a silicone material, such as silicone rubber. Preferably, the nipple material may be silicone, but could alternatively be other materials, such as thermoplastic elastomers (TPE's), such as polyisoprene, and others compatible for nursing.

It will be noted that, while described in the environment of human infant feed, the invention has broader application to animal feeding, providing fluids to non-infants, and so on.

The nipple 10 here is formed of two subparts including a substantially solid nipple portion 12 at a proximal end thereof for insertion into an infant's mouth and for conveying fluids therethrough from an attached bottle (not shown). Proximal and distal, being indicative terms, are chosen here with respect to the user (e.g., the infant). The nipple portion is a generally cylindrical substantially solid body. However, it is understood that the nipple can be in other shapes such as "orthodontic" designs. The term "substantially solid", for purposes of the present application, is broadly defined as a range from completely solid (i.e., including no voids or hollows except for the existence of one or more generally narrow ducts for conveying fluid), to having a hollow interior defined by sidewalls that include one or more ducts formed therethrough where the ducts have a significantly greater longitudinal length than radial width. As will be appreciated, there are certain functional attributes for the "solid" nipple portion 12 of this aspect of the invention that do not require a completely solid construct.

Preferably, the material of which the nipple portion 12 is fabricated has a Durometer A (or Shore A) hardness that is substantially within the range of about 1 to about 20. More preferably, the first material has a Durometer A hardness that is within the range of 1 to about 3, or switching to the Shore 00 scale, most preferably in the range of about 20 to about 45. Below the latter range is nonetheless also considered efficacious. It will be understood that the use of the phraseology "less than x" or "less than about x" includes x.

The nipple 10 includes a second subpart or mounting portion 14 formed at a distal end thereof, which is designed to be attachable to a container in a fluid-tight manner. Alternatively, a secondary collar or like attachment piece could be used to attach the nipple 10 to the container. The material of which mounting portion 14 is fabricated preferably has a Durometer A hardness that may be formed of the same or a greater Durometer hardness than nipple portion 12. In one embodiment, the mounting portion 14 has a Durometer A hardness that is within the range of about 1 to about 100. More preferably, the material of the mounting portion 14 has a Durometer A hardness that is substantially within the range of about 20 to about 90, or even more preferably in the range of about 70 to about 90.

Figure 1A:
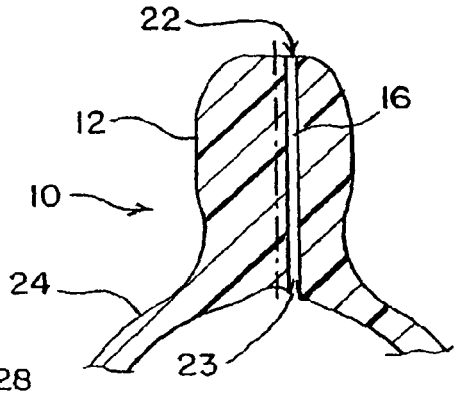
FIG. 1A is an enlarged view of ducts with valves in a variation of the nipple of FIG. 1.
Figure 2:
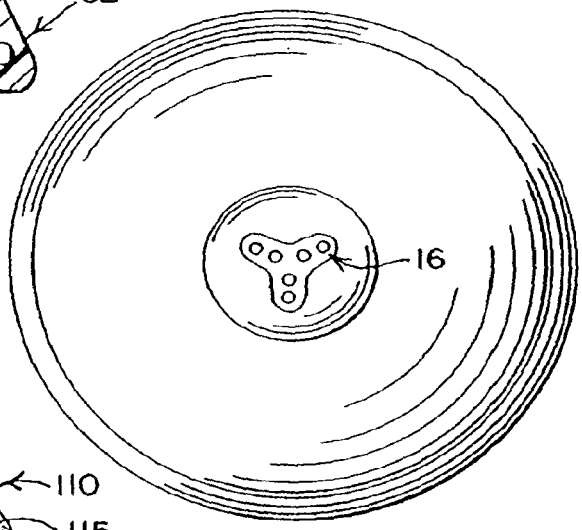
FIG. 2 is a reduced-size bottom view of the nipple of FIG. 1.

The nipple portion 12 illustrated in FIGS. 1 and 2 include a plurality of is ducts 16. Any number of ducts 16 may be used, including just one. The ducts 16 are longitudinal (axial) passageways formed in the material of the nipple 12. Each duct includes an inner opening 18 in communication with an inner chamber 20 of the nipple 10. Each duct includes an outer opening 22 that is open to the exterior of the nipple. Fluid may flow from chamber 20, into inner openings 18, through ducts 16 and out through outer openings 22. In an alternate embodiment, the outer openings 22 may include valve devices 23 (FIG. 1A), the function of which is at least in part to control, reduce or prevent passage of fluid therethrough in certain circumstances.

A flange-like skirt or transitional member 24 extends generally radially from the nipple portion 12 to an upper annular surface 26 of the mounting portion 14. The main body 28 of the mounting portion 14 may be formed of a gently concave cylinder 30, although this concavity is not required. A lower part 32 of the mounting portion 14 includes an inner lip 34 and a lower lip 36 with an inner groove 38 defined therebetween. The lower part 32 may be elastically deformed so as to be received on a container (not shown) and wherein the inner groove 38 is fitted over a corresponding mating feature on the container as in a snap-fit, screw attachment, and so on.

The nipple 10 may be formed as a single unitary part, or joined together from two or more parts. In this illustrated first embodiment, the nipple 10 is formed of two parts by a scarf-type joint 40. Adhesive bonding, heat bonding, chemical bonding, contact molding, ultrasonic welding or any suitable method may hold the joint 40 together. It will be understood that any suitable method of forming the nipple 10 may be employed, such as molding, casting, or two-shot molding, for example.

FIG. 2 illustrates one embodiment of an arrangement of the ducts 16. The ducts 16 number six individual ducts, although any suitable number of ducts is contemplated. The ducts are arranged in a triangular pattern, each vertice of the triangle similarly spaced from a middle or central axis of the nipple. Two ducts 16 comprise a set and are positioned so as to be arranged axially outwardly in a line from the central axis. Other arrangements of ducts are contemplated that effectively convey fluids through the nipple 10; this is just one such. As discussed above, the ducts 16 may terminate with a round hole, slit, chisel, "S"-shaped aperture or "Y"-shaped aperture (not shown), for example, or any suitable terminal aperture shape. The termination of the ducts, whether a slit or other shape, may function as a valve.

Figure 3:
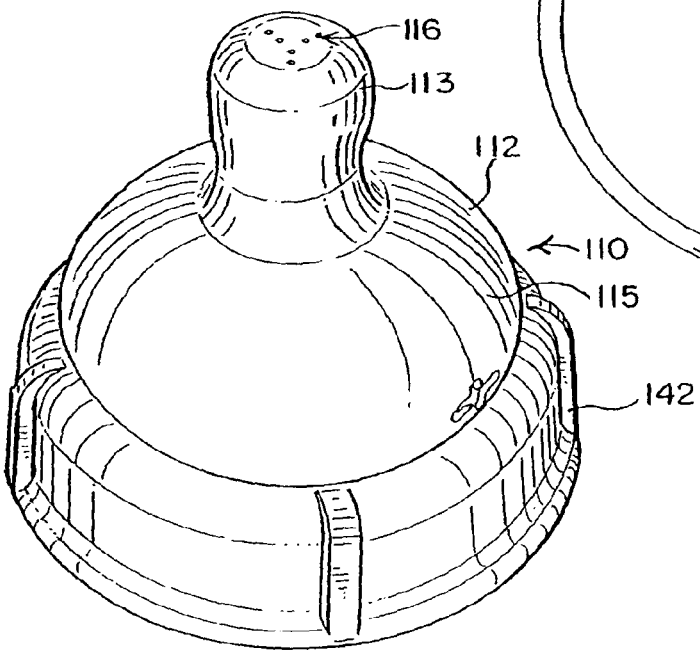
FIG. 3 is a perspective view of a second embodiment of an integral nipple is according to the present invention.

FIG. 3 shows another embodiment of the present invention. In the illustrated embodiment, the nipple 110 is formed of a two-part construction. The nipple portion 112 includes a substantially solid nipple end 113, which extends to a hollow, dome-shaped body 115. The nipple portion 112 is similar to that described above, i.e., a substantially solid nipple body including a plurality of ducts 116 extending therethrough. The body 115 flares outward from the base of the nipple 112 and, connects to a collar 142 for connecting to a bottle (not shown).

Figure 4:
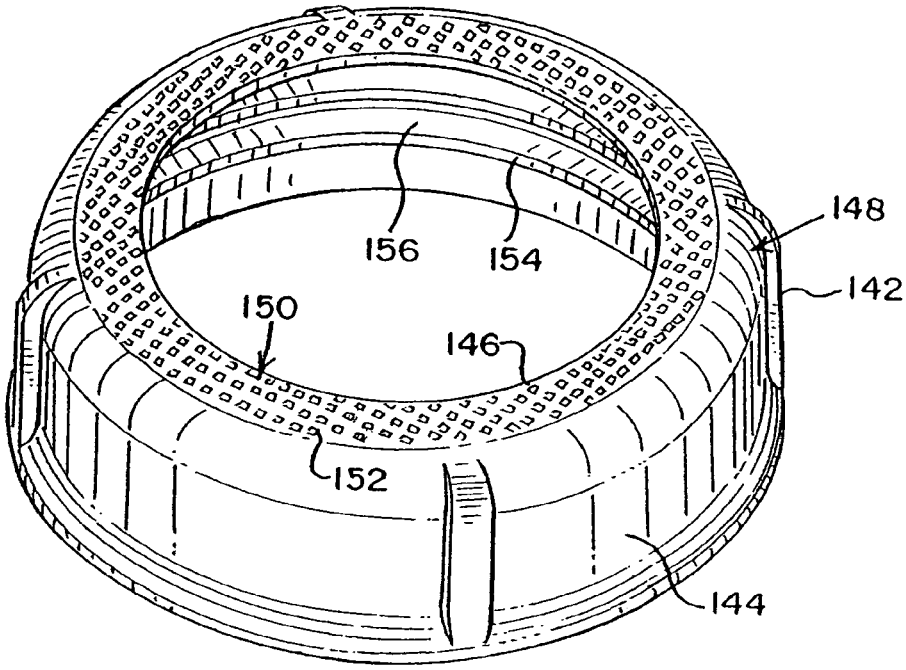
FIG. 4 is a top perspective view of the collar portion of the nipple of FIG. 3.
Figure 5:
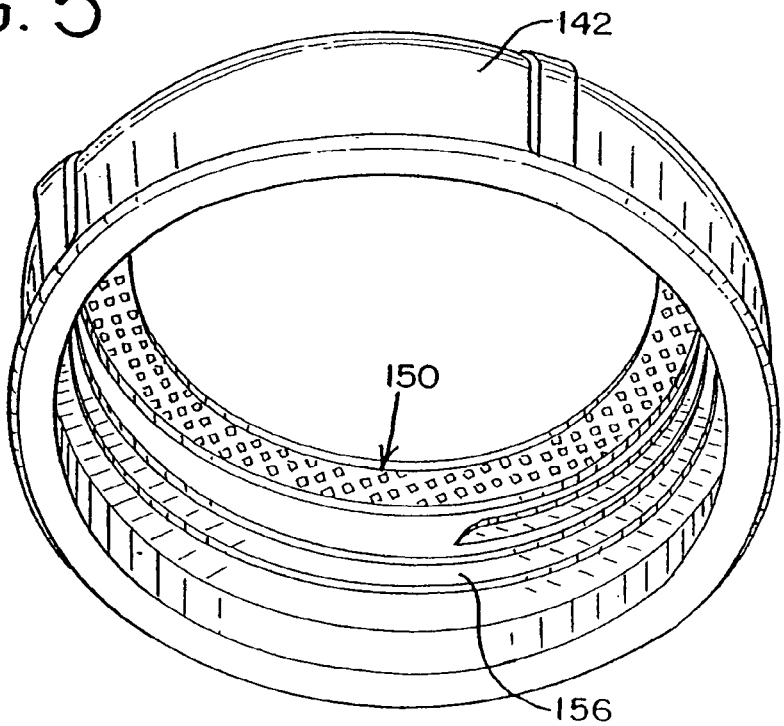
FIG. 5 is a bottom perspective view of the collar portion of FIG. 4.
Figure 6:
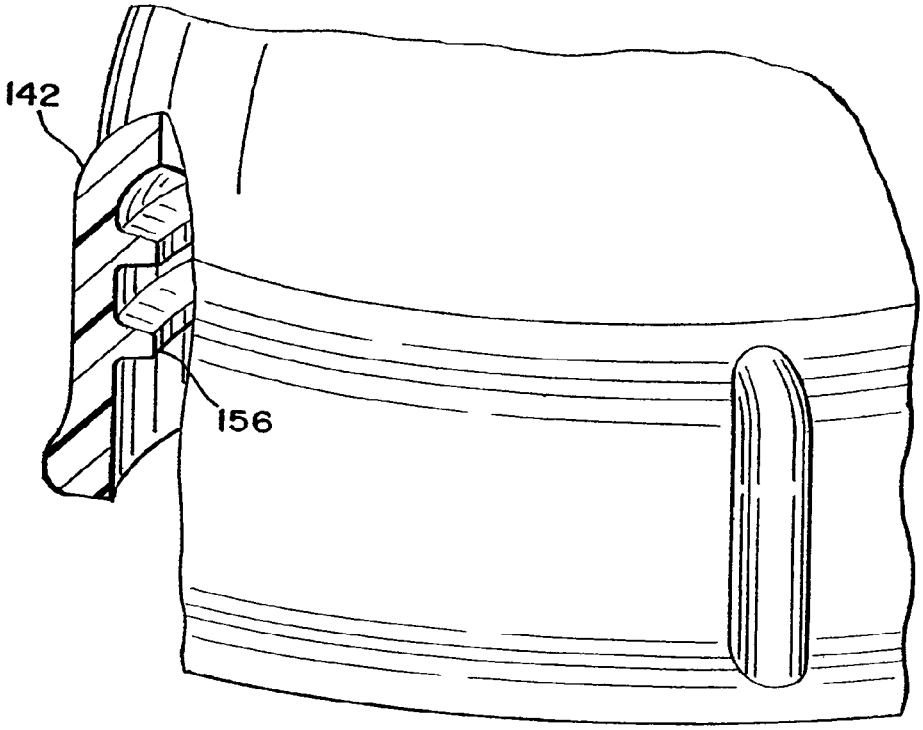
FIG. 6 is an enlarged and partially sectional illustration of a portion of the nipple of FIG. 3.

FIG. 4 shows one embodiment of a collar 142 according to the present invention. The collar 142 here is formed of a rigid plastic material. The collar 142 includes an annular sidewall 144. A mounting ring 146 is positioned at a top end 148 of the collar 142. The mounting ring 146 is formed radially inwardly form the sidewall 144 and includes a foraminous configuration 150. The configuration 150 is formed of a latticework defining openings 152 therebetween. The configuration 150 may be formed of a plurality of closely spaced openings 152 or any suitable method of providing passageways through the material of the collar. The openings 152 of the configuration 148 are provided so as to permit material of the body 115 to penetrate through the mounting ring 146 and become securely affixed thereto in manufacture. An inner surface 154 of the collar 142 may include a device for fastening the collar 142 to a bottle, such as, for example, a set of threads 156 (see FIGS. 5, 6, 7 and 8).

Figure 7:
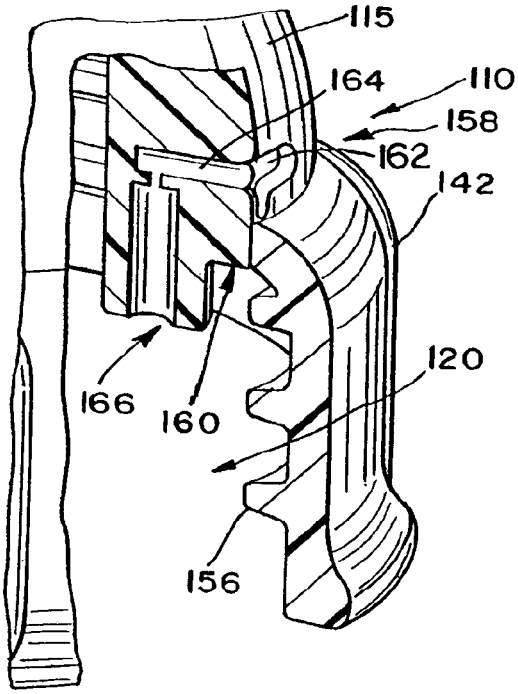
FIG. 7 is an enlarged and partially sectional illustration of another portion of the nipple of FIG. 3.

Referring to FIG. 7, this view of the embodiment of the artificial nipple 110 of the present invention details the attachment of the nipple body 115 and collar 142. In particular, a lower end 158 of the nipple body 115 is positioned by molding, casting or the like so as to be intermingled or extended through the openings 152 of the mounting ring 146. As a result, a lowermost surface 160 (and see FIG. 8) is created on the lower end 158, which is oriented downwardly and positioned so as to sealingly engage a corresponding surface of a nursing bottle, container or the like.

Figure 8:
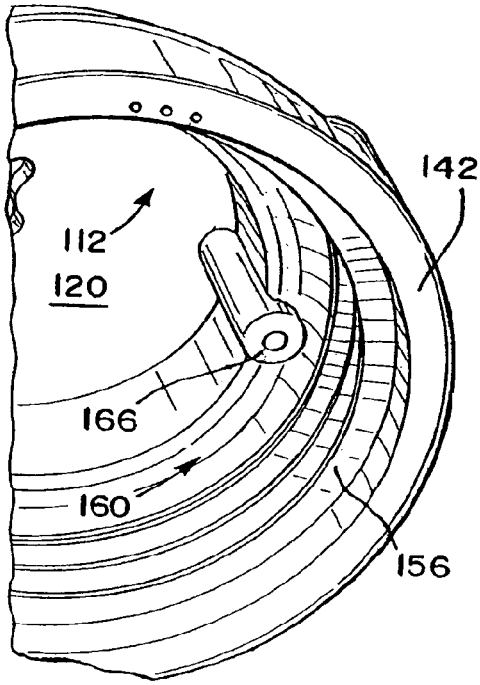
FIG. 8 is an enlarged bottom perspective view of the nipple of FIG. 3.

A vent 162 is shown in FIG. 7, for instance. As noted, the lower end 158 of the body 115 is joined to the collar 142. A horizontal passageway 164 is formed through the sidewall material of the nipple body 115. The passageway 164 is open to atmosphere at an outside end, and communicates at an inside end with a vertical passageway or air inlet 166 (FIG. 8). The vertical passageway 166 is in communication with inner chamber 120 of the nipple body 115.

FIG. 8 shows the nipple described in FIG. 3 from a bottom perspective view. The vertical passageway 166 is open to the inner chamber 120. Also, the sealing surface 160 is shown generally at a position whereby the nipple portion 112 joins the collar 142.

Figure 9:
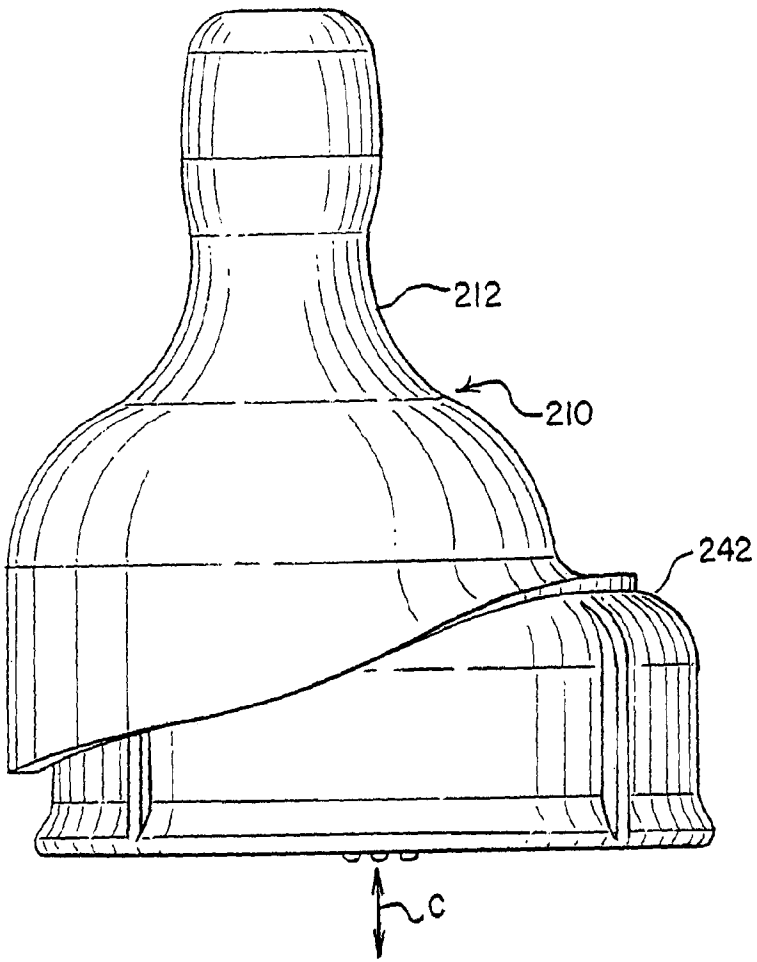
FIG. 9 is a perspective view of a third embodiment of an integral nipple according to the present invention.

FIG. 9 shows an embodiment of the artificial nipple 210 of the present invention wherein the nipple portion 212 is offset with respect to a centerline "C" drawn along the center axis of the collar 242. This embodiment positions the nipple lower compared to the fluid level in the bottle. This helps to position the bottle so that milk, instead of air, is at the ducts. It also can improve positioning for feeding. Also, a vent may be positioned on an opposite side from the nipple ducts so as to be higher when in use and thus, properly venting.

Figure 10:
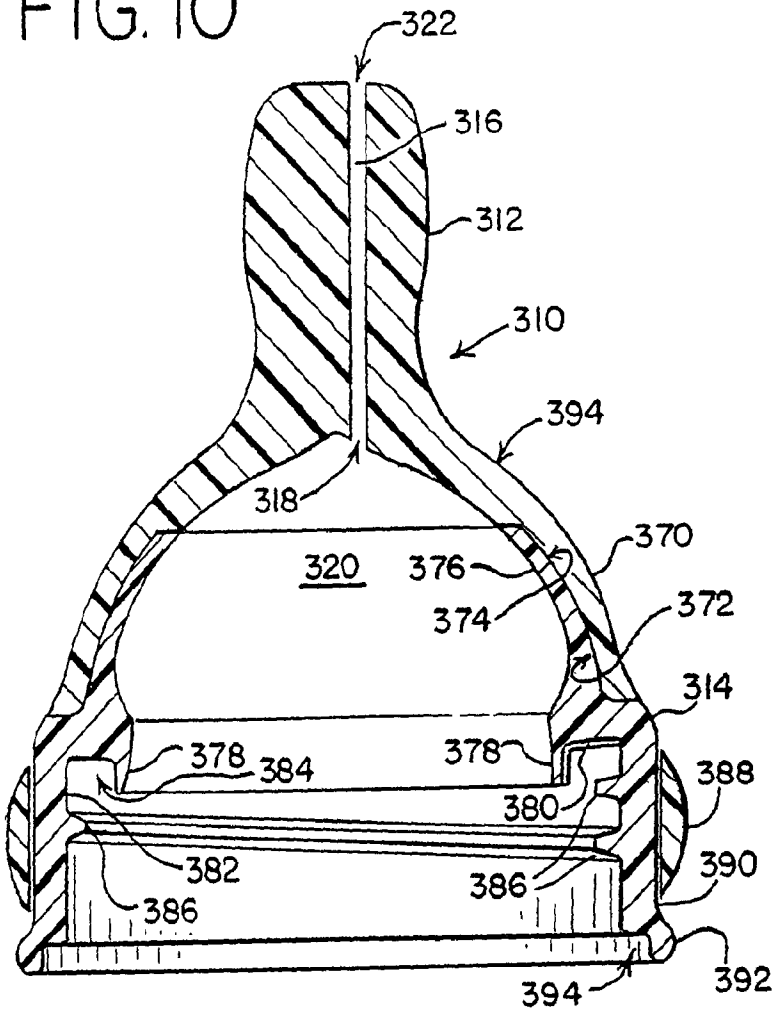
FIG. 10 is a sectional view of a fourth embodiment of a nipple according to the present invention.

FIG. 10 shows still another embodiment of an artificial nipple according to the present invention. The nipple, illustrated generally at 310, is intended for use with a container, such as a bottle or bag. As in the above-described examples, the nipple 310 may be made of any suitable material, but in a preferred form is made of a silicone material, such as silicone rubber.

The nipple 310 may be formed of two subparts including a substantially solid nipple portion 312 at an upper or proximal end thereof for insertion into an infant's mouth and for conveying fluids therethrough from an attached container (not shown) and a lower or distal end including a mounting portion 314 for attachment to the container.

The nipple portion 312 is a generally cylindrical and substantially solid body. Again, the material of which the nipple portion 312 is fabricated is of a Durometer A (or Shore A) hardness that is substantially within the previously described preferred range. Of course, other shapes besides cylindrical can be used, such as orthodontic-type nipples, and so forth.

Figure 12:
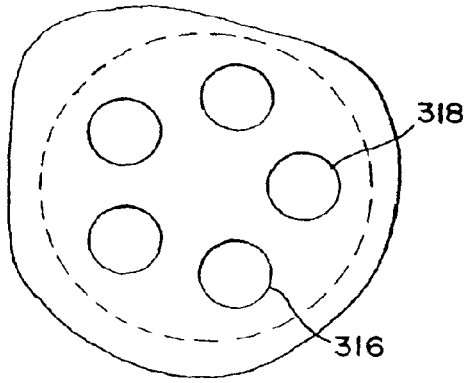
FIG. 12 is a bottom view of one embodiment of an arrangement of fluid ducts according to the present invention.

The nipple portion 312 includes a plurality of ducts 316 (see FIG. 12). The ducts 316 are longitudinal (axial) passageways formed in the material of the nipple 312. Each duct includes an inner opening 318 in communication with an inner chamber 320 of the nipple 310. Each duct 316 includes an outer opening 322 that is open to the exterior of the nipple. The ducts 316 may be arranged as shown in FIG. 2 or, in the alternate as shown in FIG. 12, or any suitable effective arrangement which takes into account the nipple 312 material and other factors such as the length of the ducts through the nipple, and the amount of flow through desired.

During use, fluid may flow from chamber 320, into inner openings 318, through ducts 316 and out through outer openings 322. In an alternate embodiment, the outer openings 322 may include valve devices (not shown in this version, but see, for instance, FIGS. 16A-16C and related discussion thereof).

Figure 11:
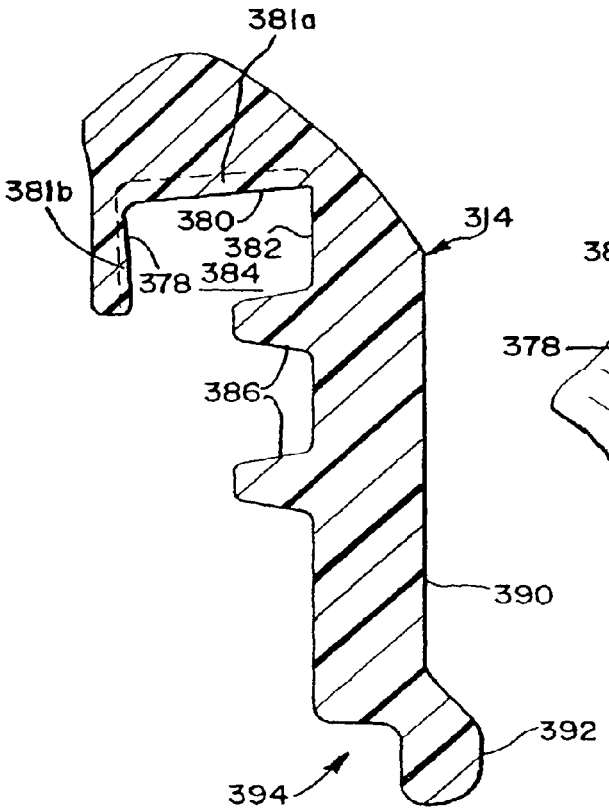
FIG. 11 is an enlarged partial sectional view of a mounting portion of the nipple of FIG. 10.

As shown in FIGS. 10 and 11, the second subpart or mounting portion 314 extends from and is attached to the nipple portion 312. The mounting portion 314 is attachable to a container in a secure, fluid-tight matter. The material of mounting portion 314 is fabricated of a material that may be of about the same or a greater Durometer hardness than nipple portion 312. Here, the mounting portion 314 has a Durometer A hardness that is within the range of about 1 to about 100. More preferably, the material of the mounting portion 314 has a is Durometer A hardness that is substantially within the range of about 20 to about 90. It will be understood that the mounting portion should have a Durometer A hardness sufficient to enable secure and leak-free attachment to a container. Sandblasting the mold for the mounting portion 314 to provide a matte-type finish for the molded piece in the threaded area is useful for reducing friction when screwing the nipple on a container.

The nipple portion 312 extends into a dome-like structure to form skirt 370 at a lower portion thereof. An inner face 372 of the skirt portion 370 overlaps and connects to an outer face 374 of a corresponding upper engaging section 376 of the mounting portion 314. Adjacent and below the upper engaging section 376 of the mounting portion 314, and shown in more detail in FIG. 11, is an inner lip 378 positioned radially inboard from a generally horizontal land 380, which, with inner wall 382, define a generally open channel 384 for sealingly engaging with a container such as a top of a bottle (not shown). The inner wall 382 may be provided with a thread feature 386 to engage a corresponding feature on the container. The thread feature 386 may be a single raised thread as shown, or any suitable numbers of threads for engagement with the container. Furthermore, the horizontal land 380 and inner lip may include a channel 381*a* and 381*b* formed therein which functions as a vent.

Figure 11A:
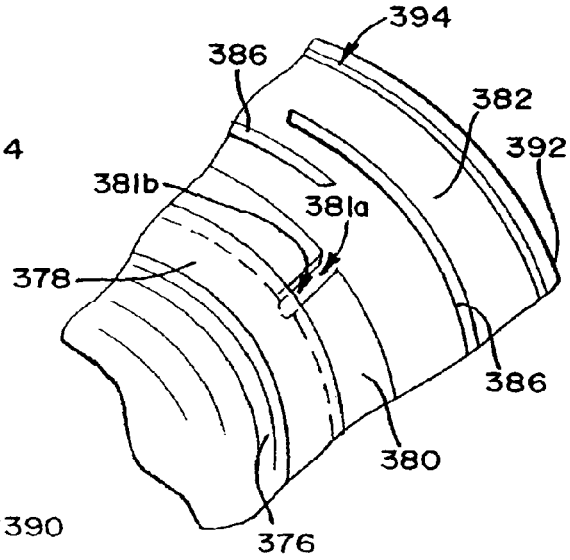
FIG. 11A is a partial cut-away perspective view showing the vent of FIG. 11.

Channel 381*a* and 381*b* is also shown in FIG. 11A. It has a radial part 381*a* that extends across the land 380 from the inner sidewall 382 to the inner lip 378. While inner lip 378 is relatively thin in its radial dimension, channel part 381*b* is nonetheless formed therein on its outboard facing side and mates with the inside wall of the bottle. This vent structure 281*b* does not appreciably change whether the nipple is screwed on with a small or a larger force. Radial channel part 381*a* is deep enough that it can be compressed without affecting venting.

The dome-like structure of skirt portion 370 has a lower rim section 394. In one embodiment, the low Durometer material of the nipple portion 312 extends to the lower rim 394. Alternatively, the lowest Durometer material stops at the bottom of the skirt 370. The flexibility of the nipple 310 and its general exterior softness can thus be suitably modified in this simple manner.

A retaining ring 388, preferably made of a rigid plastic, may be positioned abut the outer peripheral surface 390 of the mounting portion 314. The retaining ring 388 reinforces the mounting portion 314 over the thread feature 386, thereby assisting the mating of the thread feature 386 with the container, and prevents the mounting portion 314 from flexing outwardly when being attached thereto. The retaining ring 388 is held in place at least in part by a bead 392 formed at the rim section 394 of mounting portion 314. The ring 388 can advantageously be color coded to indicate a feature of the nipple 312, such as where a plurality of nipples are available in different shapes, flow rates, softness and so forth. Other differentiating indicia may be used besides color-coding, of course.

In this illustrated embodiment, the nipple 310 is formed from nipple portion 312 and mounting portion 314 by co-molding, adhesive bonding, heat bonding, chemical bonding, casting or any suitable method to unite the two. Again, the mold in which the present invention is molded may be sandblasted in order to produce a heavy matte finish on the nipple. In this manner, friction is reduced when screwing the nipple onto a container. This is particularly advantageous in a mounting portion made of silicone rubber or similar elastomer.

Figure 13:
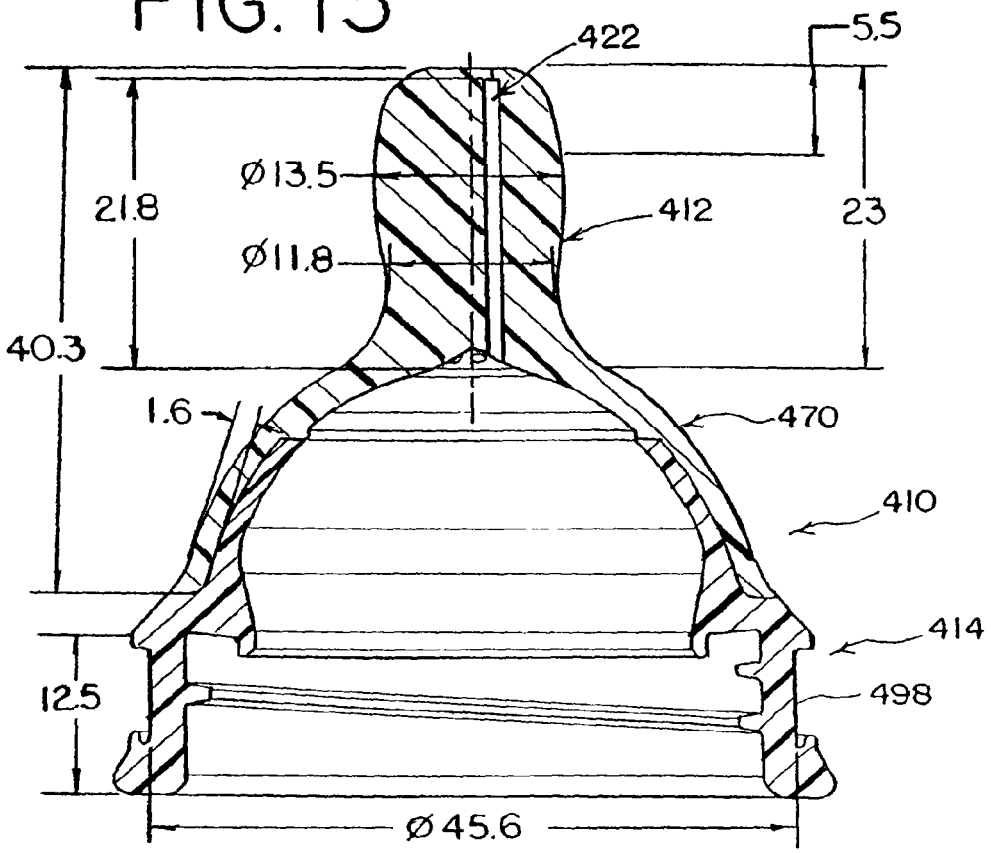
FIG. 13 is a sectional view of an embodiment of a nipple similar to that shown in FIG. 10, illustrating some of the nipple dimensions.

Turning to FIG. 13, another embodiment of the present invention is shown to illustrate a set of dimensions of a preferred nipple. It will be understood that the dimensions, lengths, widths, radii, and so on as provided herein are changeable according to a number of variables related to the material used to form the nipple, the intended end user, manufacturing, flow and other factors. The provided dimensions are intended to illustrate a preferred embodiment and to are not intended to be limiting. Structurally and dimensionally, the nipple 410 shown in FIG. 13 is similar to that shown in FIG. 10, and therefore these dimensions may be beneficially applied to the nipple shown and described in FIG. 10, for example, as well as other embodiments.

As above, the nipple 410 includes a nipple portion 412 and a mounting portion 414. Preferably, the nipple portion 412 is made of a platinum cured or similar silicone rubber having a Shore A hardness in the ranges previously indicated. The nipple portion 412 of the nipple 410 has an insertable axial length of about 23 mm, a greater diameter of 13.5 mm and a lesser diameter of 11.8 mm. At times the suckling infant may also insert more of the nipple than just the first 23 mm of nipple portion 412 and may also insert some or even all of the skirt 470. The overall length of the nipple portion is 40.3 mm. It will be noted that the flexibility, and extensibility of this transition area between the elongated nipple portion and the mounting base, is very like that of the areola of the mother. Like the elongated nipple itself, the skirt 470 area stretches and elongated in the month.

The duct 422, formed in the nipple portion 412 is formed by a 21.8 mm pin in a molding process using platinum cured silicone rubber as the molded nipple material. The duct 422 is 1.1 mm in diameter. There may be more than one duct 422.

The mounting portion 414 is made of a silicone rubber having a Shore A hardness of 80. The depicted embodiment differs from that shown in FIG. 10, in that, an annular peripheral channel 498 is formed about the mounting portion for a retaining ring (not shown, e.g., ring 388). The width of the mounting portion reaches 45.6 mm. Other features of this nipple are the same as those described, and set out in FIG. 10.

Figure 14:
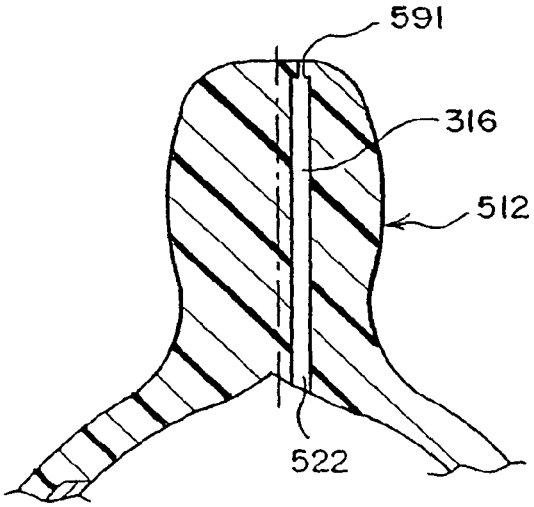
FIG. 14 is an enlarged partial sectional view of the nipple of FIG. 10.
Figure 15:
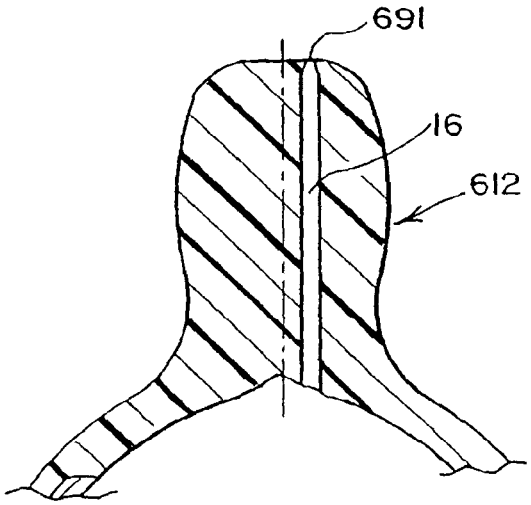
FIG. 15 is an enlarged partial sectional view of another embodiment of the nipple of FIG. 10.

Turning to FIG. 14, the nipple portion 512 includes a duct 522 with a modified terminal aperture 591. The cylindrical duct is 1.1 mm in diameter. The terminal aperture 591 is round in cross section and 0.15 mm in diameter. The nipple portion 612 depicted in FIG. 15 has another embodiment of a modified terminal aperture or terminus 691, which is chisel shaped to provide a slit-shaped opening. In this manner, the terminal aperture 691 may beneficially function to prohibit unintended flow through the nipple and other beneficial flow characteristics.

Figure 16A:
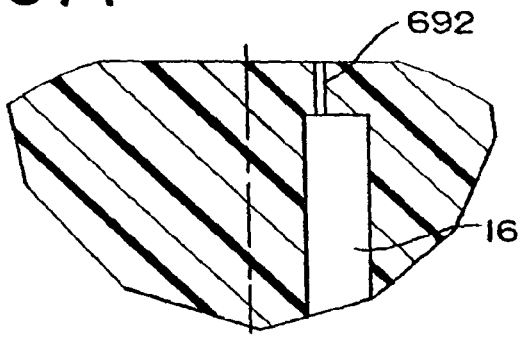
FIGS. 16A-16C are sectional views of various types of termini for ducts.

FIG. 16A shows another variation on a nipple end structure wherein the duct 16 (or indeed any of the other ducts described herein) has a generally cylindrical internal cavity terminating in a small diameter outlet 692. FIG. 17B shows an end-view of such a structure.

Figure 16B:
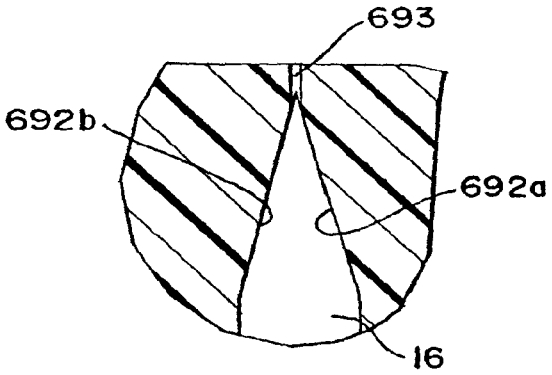
Figure 17A:
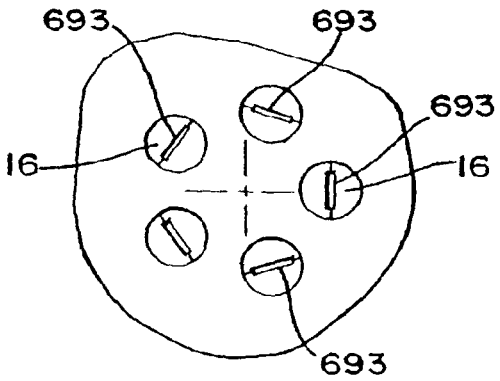
FIGS. 17A-17B are end views of nipples formed with the foregoing termini.
Figure 17B:
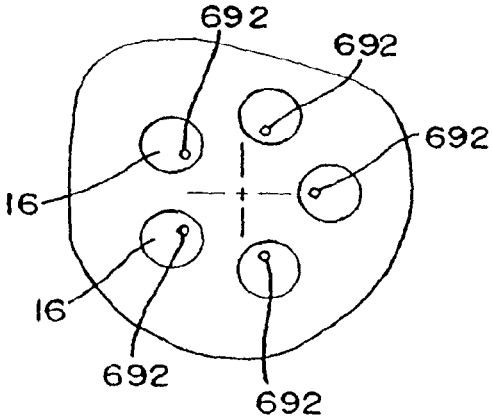

FIG. 16B shows a chisel-shaped terminus for the duct 16, with opposed sidewalls 692*a* and 692*b* which end in a slit 693, the latter shown in end-view in FIG. 17A.

Figure 16C:
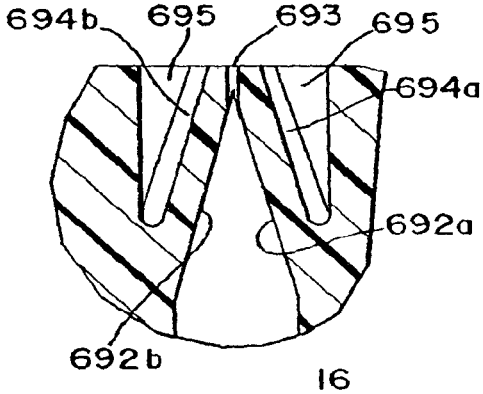

FIG. 16C is yet another terminus structure for the nipple duct 16, this also having a chisel-shape 692*a* and 692*b* ending in a slit 693. Outboard sidewalls 694*a* and 694*b* defined within a well 695 give this structure a duck-bill configuration.

All of these terminal structures in FIGS. 16A-16C, and indeed the inboard end structure of FIG. 1A, serve as valves for allowing fluid flow out through the nipple, but generally (or substantially completely in certain structures) preventing flow back into the nipple.

Figure 18:
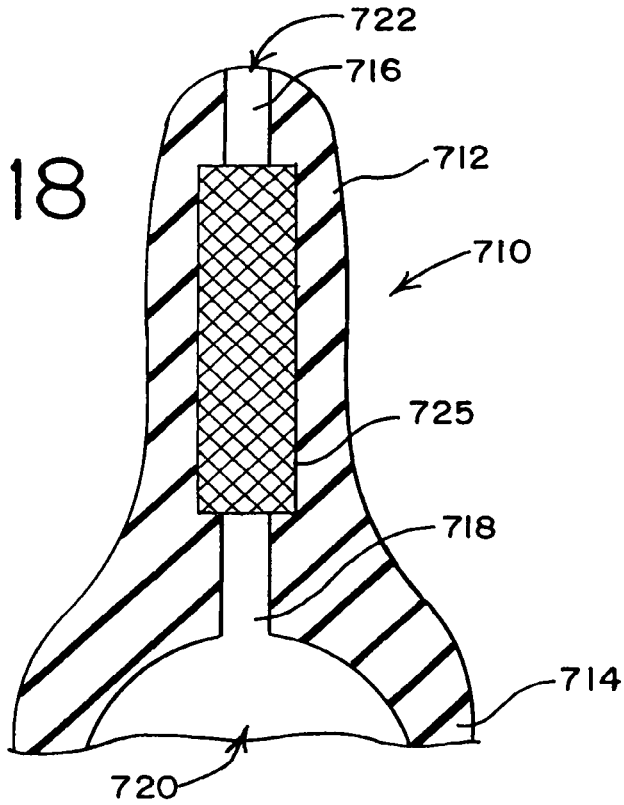
FIG. 18 is a sectional view of one embodiment having a tubular mesh reinforcement embedded in the nipple.

FIG. 18 shows still another embodiment of an artificial nipple according to the present invention. The nipple, illustrated generally at 710, is intended for use with a container, such as a bottle or bag. As in the above-described examples, the nipple 710 may be made of any suitable material, but in a preferred form is made of a silicone material, such as silicone rubber.

The nipple 710 may be formed of two general portions, namely a substantially solid nipple portion 712 at an upper or proximal end thereof for insertion into an infant's mouth and for conveying fluids therethrough from an attached container (not shown) and a lower or distal end including a mounting portion 714 for attachment to the container.

The nipple portion 712 is preferably a generally cylindrical and substantially solid body. The material of which the nipple portion 712 is preferably fabricated is of a low Durometer A (or Shore A) hardness in the preferred range of about 0 to 45. Of course, other shapes besides cylindrical can be used, such as orthodontic-type nipples, and so forth.

The nipple portion 712 includes a plurality of ducts 716. The ducts 716 are longitudinal (axial) passageways formed in the material of the nipple 710. Each duct includes an inner opening 718 in communication with an inner chamber 720 of the nipple 710. Each duct 716 includes an outer opening 722 that is open to the exterior of the nipple 710. The ducts 716 may be arranged as shown or, in the alternate, any suitable effective arrangement.

An embodiment of a reinforcing member 725 is disposed in the nipple 710. The reinforcing member 725 is positioned in the nipple 710 and oriented axially about the ducts 716 in a close, but spaced configuration. Structurally, the reinforcing member 725 may be a number of configurations. The reinforcing member 725 shown includes an open, hollow cylinder or sheath of material.

The wall of the reinforcing member 725 may be solid or not solid. For example, the reinforcing member 725 may be cylindrical, woven or fibroid, mesh, knitted, interlaced strands of material, porous, strips, helical, spiral ribbed, and in cross section may be round, wheel-shaped, spoke-shaped, ribbed or any suitable shape. The reinforcing member 725 may extend along the length of the ducts 716 or along a portion of the length of the ducts.

The illustrated reinforcing member 725 may be woven polyester or nylon, for example. Non-woven examples may be made of platinum cured silicon having a relatively higher Durometer than the surrounding material of the nipple portion 712. One embodiment includes a Durometer A of about 50.

The nipple 710 may be formed by co-molding, adhesive bonding, heat bonding, chemical bonding, casting or any suitable method to unite the two portions. The mold in which the present invention is molded may be sandblasted to in order to produce a heavy matte finish on the nipple. This is particularly advantageous in a mounting portion made of silicone rubber or similar elastomer.

Figure 19A:
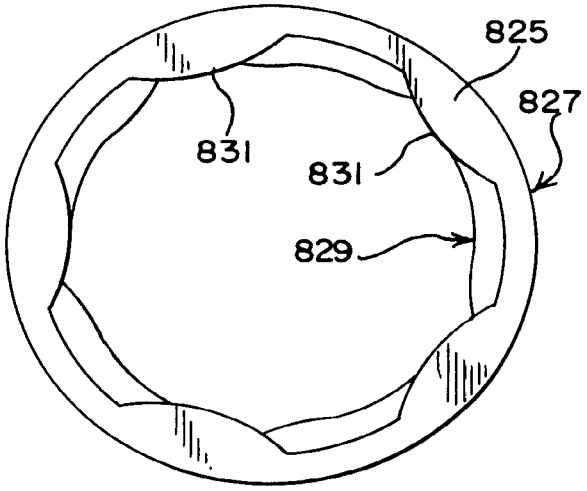
FIG. 19A is a cross-sectional view looking along the long axis of a helical-type extrusion for use as a reinforcement element in a nipple.
Figure 19B:
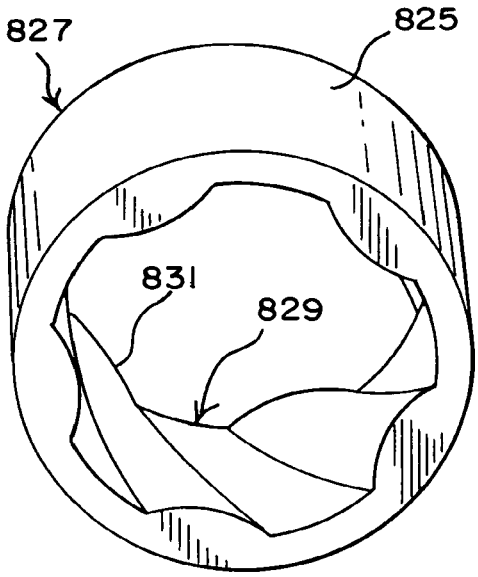
FIG. 19B is a perspective view of the embodiment of FIG. 19A.

FIGS. 19A and 19B show an extrusion, which when inserted into a nipple (See FIG. 18) functions as a reinforcing member 825. The reinforcing member includes a smooth cylindrical outer surface 827 and an inside surface 829 including a plurality of helical ribs 831. Of course, while five ribs 831 are shown, other numbers of ribs may be used. The ribs 831 may be non-helical. In this embodiment, the reinforcing member 825 is positioned in a nipple such that all of the ducts pass through the interior of the reinforcing member. Other examples include ducts passing outside of the reinforcing member.

FIG. 20 shows an alternate embodiment of a reinforcing member 925 wherein the cross sectional shape of the member is generally star-shaped with five radiating arms or walls 933. Ducts 916 of the nipple (not shown) are interposed between adjacent walls 933. One embodiment of the invention includes ducts 916A formed closely adjacent the walls 933 and another embodiment of the invention is shown wherein the ducts 916B are formed near or outboard of the terminus of the walls. In this example of the invention, the reinforcing member 925 is positioned along the central axis of the nipple.

FIG. 21 shows yet another embodiment of a reinforcing member 1025 which generally takes the form of a wheel with spokes. The outer surface 1027 may be a smooth cylinder, which surrounds a central hub 1035. Connecting the hub 1035 and outer surface 1027 are a number of spokes 1033 which define channels 1037 therebetween. Ducts 1016 are formed in the nipple material in the channels 1037.

FIG. 22 shows a reinforcement member 1125 similar to the embodiment shown in FIGS. 19A and 19B. The reinforcement member 1125 is generally a hollow, cylindrical shape disposed in a nipple portion 1112 of a nipple. Ducts 1116 are formed through the nipple portion 1112 inside the reinforcement member 1125. Interior helical ribs 1131 are formed on the inside of the reinforcement member 1125. Exterior helical ribs 1139 are formed on the outside of the reinforcement member 1125.

FIG. 23 shows a bottom view of a nipple 910 including the embodiment of a reinforcing member 925 shown in section in FIG. 20. The bottom section 914 of the nipple 910 is shown wherein the ducts 916 are positioned between adjacent walls 933 of the reinforcing member 925.

Thus, while the invention has been described with respect to certain preferred embodiments, it will be understood by those of skill in the art that there are modifications, substitutions and other changes that can be made, yet will still fall within the intended scope of the invention, as set forth in the following claims.

What is claimed is:

1. An improved feeding nipple, comprising:

a substantially elongated solid nipple part including one or more ducts formed therethrough for conveying fluids through said nipple, said elongated nipple part having a shore A hardness in the range of 1 to about 20, said one or more ducts being radially compressible by a suckling infant's oral action so as to prevent passage of fluids through said one or more ducts when so compressed, wherein said one or more ducts are at least 10 times greater in longitudinal length than radial width; and a generally cylindrical reinforcing member disposed in said solid nipple part and oriented axially adjacent to and surrounding said one or more ducts generally along said length, said reinforcing member being embedded in said solid nipple part, said reinforcing member having a greater resistance to a tearing force than said solid nipple part.

2. The nipple of claim 1 wherein said reinforcing member is extensible along a longitudinal axis.

3. The nipple of claim 1 wherein said reinforcing member is tubular.

4. The nipple of claim 3 wherein said reinforcing member surrounds a plurality of ducts formed through said nipple.

5. An improved feeding nipple, comprising: a substantially solid nipple including one or more ducts formed therethrough for conveying fluids through said nipple, said nipple being radially compressible so as to prevent passage of fluids through said one or more ducts when so compressed, wherein said one or more ducts are at least 10 times greater in longitudinal length than radial width; and a reinforcing member disposed in said solid nipple and oriented axially adjacent to said one or more ducts, wherein the nipple has a Shore A hardness of less than about 10, and said reinforcing member is made of a material having a greater hardness.

6. The nipple of claim 3 wherein said nipple has a unitary nipple portion and a mounting portion, said mounting portion being adapted for use in attaching said nipple, said mounting portion being formed of a material of a greater Shore A hardness than that of the nipple portion.

7. An improved feeding nipple, comprising: a substantially solid nipple including one or more ducts formed therethrough for conveying fluids through said nipple, said nipple having a shore A hardness in the range of 1 to about 20 or a shore 00 hardness in the range of about 20 to about 45, said one or more ducts being radially compressible by a suckling infant's oral action so as to prevent passage of fluids through said one or more ducts when so compressed, wherein said one or more ducts are at least 10 times greater in longitudinal length than radial width; and a reinforcing member disposed in said solid nipple and oriented axially adjacent to said one or more ducts, wherein the nipple includes a plurality of ducts, said reinforcing member being tubular and generally cylindrical in shape, said reinforcing member surrounding said ducts.

8. The nipple of claim 7 wherein said reinforcing member is made of an open mesh material.

9. The nipple of claim 7 wherein said reinforcing member is formed of an open mesh and is embedded within said nipple.

10. An improved feeding nipple, comprising: a substantially elongated solid nipple part including one or more ducts formed therethrough for conveying fluids through said nipple, said solid nipple part having a shore A hardness in the range of 1 to about 20, said one or more ducts being radially compressible so as to prevent passage of fluids through said one or more ducts when so compressed under oral action by an infant; and a generally cylindrical reinforcing member embedded in said solid nipple part and surrounding a substantial portion of the length of said one or more ducts, and said reinforcing member having a greater resistance to a tearing force than said solid nipple part.

11. An improved feeding nipple, comprising: a substantially elongated solid nipple part including one or more ducts formed therethrough for conveying fluids through said nipple, said solid nipple part having a shore A hardness in the range of 1 to about 20, said one or more ducts being radially compressible so as to prevent passage of fluids through said one or more ducts when so compressed by mouth action of a suckling infant; and a generally cylindrical reinforcing member embedded in said solid nipple part in a close but spaced configuration relative to said one or more ducts, and said reinforcing member having a greater resistance to a tearing force than said solid nipple part.

* * * * *